US005931515A

United States Patent [19]

Stendal

[11] Patent Number: 5,931,515

[45] Date of Patent: Aug. 3, 1999

[54] LOCKING DEVICE FOR DOORS

[75] Inventor: Jan Stendal, Västerås, Sweden

[73] Assignee: Stendals Elektriska AB, Vasteras, Sweden

[21] Appl. No.: 08/875,604

[22] PCT Filed: Feb. 17, 1995

[86] PCT No.: PCT/SE96/00166

§ 371 Date: Aug. 5, 1997

§ 102(e) Date: Aug. 5, 1997

[87] PCT Pub. No.: WO96/25578

PCT Pub. Date: Aug. 22, 1996

[30] Foreign Application Priority Data

Feb. 17, 1995 [SE] Sweden ..... 9500582

[51] Int. Cl.[6] ..... E05C 1/04

[52] U.S. Cl. ..... 292/153; 292/139; 292/335

[58] Field of Search ..... 292/153, 139, 292/146, 163, 167, 36, 335, 332, 165, 170, DIG. 4

[56] References Cited

U.S. PATENT DOCUMENTS

| | | | |
|---|---|---|---|
| 3,464,728 | 9/1969 | Ruckel et al. | 292/92 |
| 4,099,753 | 7/1978 | Gwozdz et al. | 292/177 |
| 5,195,792 | 3/1993 | Stendal | 292/341.16 |
| 5,341,752 | 8/1994 | Hambleton | 109/59 |
| 5,373,716 | 12/1994 | MacNeil | 70/109 |

*Primary Examiner*—Darnell M. Boucher
*Assistant Examiner*—John B. Walsh
*Attorney, Agent, or Firm*—Dennison, Meserole, Scheiner & Schultz

[57] ABSTRACT

A locking device for doors, intended for connection between the dead-bolt of the door and the drive means of the lock including a hinged arm which is connected to the dead-bolt or its extension, a wheel or pin being arranged at the other end of the hinged arm and designed to tumble into a recess formed in a pivotable cam-disc, or to be disengaged from this recess by means of a link mechanism, whereupon in the latter position, the cam-disc is arranged to block the dead-bolt in the first position and upon tumbling into the recess to release it, the dead-bolt has an inclined surface designed so that upon pressure against the door, the bevelled surface assists in opening of the door.

7 Claims, 1 Drawing Sheet

LOCKING DEVICE FOR DOORS

FIELD OF THE INVENTION

The present invention relates to a locking device for doors, intended for connection between the dead-bolt of the door and its drive means (door-frame or rotating cam, such as an electrical strike plate).

BACKGROUND OF THE INVENTION

It is important in different locking constructions that the lock has distinct positions, locked and unlocked. There is a risk when unlocking a door, for instance during emergency evacuation of premises, that a door cannot be opened although it has been unlocked in the normal manner. In critical situations this may have disastrous results. Both security and fire-protection aspects must be respected. The locked position shall be firm and unlocking shall not be made more difficult, for instance when a crowd of people are pushing towards the exit, thereby unintentionally preventing its opening.

OBJECT OF THE INVENTION

The object of the invention is a solution of these and other similar problems, and is characterized in that a hinged arm is connected to the dead-bolt or its extension, a wheel or pin being arranged at the other end of the arm and designed to tumble into a recess in a pivotable cam-disc upon turning of the cam-disc, and also to be disengageable from this recess, whereupon the cam-disc in the latter case is arranged to block the dead-bolt and upon tumbling into the recess release it, and also that the dead-bolt has an inclined surface designed, upon pressure against the dead-bolt, to assist in the opening process. The arrangement of dead-bolt and drive means normally provides reliable locking and unlocking and the inclined surface assists in ensuring opening even in emergency situations arising out of pressure against the door and thus against the dead-bolt, since a force component is obtained in opening direction of the dead-bolt.

The invention can be used on double doors by applying it on the passive door, where pressure is obtained from a door-frame. The drive means comprises a spring bolt actuated by a door-frame.

The invention can also be applied on a single door, such as a fire-door, where the pressure is obtained from a rotating cam, e.g. an electrical strike plate. An example of a lock for a single door where the invention can be applied, is shown in Swedish Priority patent application 8900988 now U.S. Pat. No. 5,195,792. The drive means is in this patent an electro-magnet, and the pressure is obtained from a rotating cam.

In a preferred embodiment the cam-disc is arranged to be turned either with or against spring force and the cam-disc is provided with a blocking protrusion, designed to cooperate in the locking position with a locking surface in the extension of the dead-bolt.

DETAILED DESCRIPTION OF THE INVENTION

Figure 1:
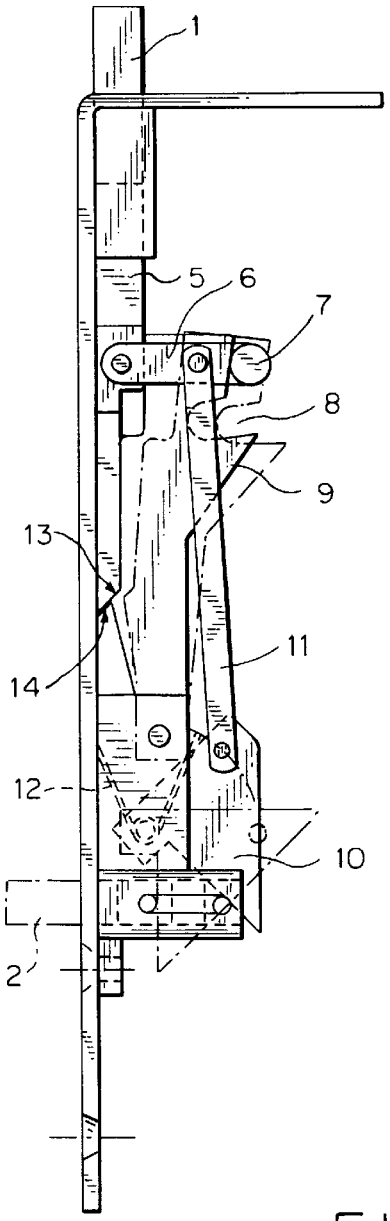
FIG. 1 is a side view of the lock.
Figure 2:
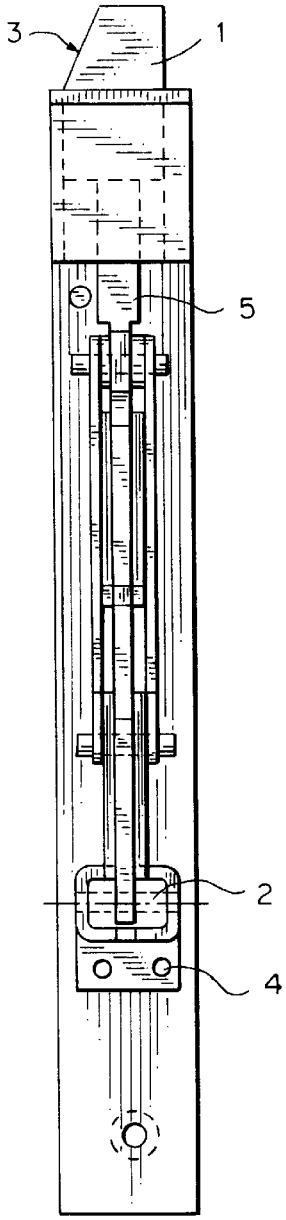
FIG. 2 is a front view of the lock.
Figure 3:
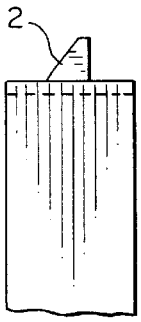
FIG. 3 is a partial side view of the spring bolt.

FIGS. 1 and 2 show the lock seen from two different directions, and FIG. 3 shows a detailed view of the spring bolt.

In FIGS. 1 and 2 a lock is shown having a dead-bolt (1) designed for engagement in a door-frame and to lock the passive door in case of double doors to a door-frame. The dead-bolt (1) is shaped with a bevelled surface (3) designed so that upon pressure against the door, a force component in the opening direction is produced. The dead-bolt has an extension (5) to which an arm (6) is hinged. A wheel (7) or pin for engagement in a recess (8) in a swivel cam-disc (9) is arranged at the outer end of the arm (6). This is the open position. To achieve locking, this wheel (7) is moved out of the recess and up along the outer edge of the cam-disc so that the cam-disc is pushed inwards and a blocking surface (13) cooperates with a locking surface in the extension (14) of the dead-bolt. This is the locked position. The arm (6) on which the wheel or pin is located, is connected to one end of a link arm (11), the other end of the link arm is connected to a swivel plate (10) which can be actuated by a spring bolt 2. If the spring bolt is pushed out, the arm (6) with the wheel or pin (7) is actuated so that the wheel tumbles into the recess and the cam-disc swings out under the influence of the force of a spring (12). This causes the blocking surface (13) to be released and the lock opens, partly due to influence from the bevelled surface (3) which receives pressure from the door-frame. The cam-disc is moved either against or with the force of the spring (12). (4) denotes attachment means for the various link mechanisms. FIG. 3 shows a side view of the spring bolt which constitutes the drive means of this lock. The device according to the invention can be varied in many ways within the scope of the following claims.

I claim:

1. A device for operating the dead-bolt of a door lock comprising:

a dead-bolt having an extension with a blocking surface;

a hinged arm having one end connected to the dead-bolt extension;

a pin arranged at the other end of said hinged arm;

a cam-disc including a recess and a locking surface; and means for pivoting the cam-disc into a first position where the dead-bolt is operative in a door opening position and said pin is tumbled into the cam-disc recess; said pivoting means is capable to move said pin out of the recess so that said cam-disc is pivoted into a second position where said dead-bolt is operative in a locked position.

2. The device according to claim 1, wherein said pivoting means includes a link-arm, a swivel plate, a spring and a spring-bolt, the spring-bolt cooperating with the swivel plate and the link-arm when the spring-bolt is actuated against the force of the spring to cause the locked position.

3. The device according to claim 2, wherein the spring-bolt is released and the force of the spring moves the swivel plate, the link arm, the hinged arm and thus the dead-bolt into the door opening position.

4. The device according to claim 1, wherein the locking surface of the cam-disc is positioned against the blocking surface of the dead-bolt so as to hold the dead-bolt in the locking position.

5. The device according to claim 3, wherein the dead bolt has a bevelled surface which aids in opening of a locked door when the pivoting means is moved to the door opening position.

6. A locking device for a door comprising:

a dead-bolt having an extension with a blocking surface;

a hinged arm having a first end connected to the dead-bolt extension and a wheel arranged at a second end;

a pivotable cam-disc including a recess and a locking surface;

said wheel arranged to tumble into the recess upon turning of the cam-disc so that the dead-bolt is held in an open position;

a spring bolt;

a link mechanism actuatable by the spring bolt, said link mechanism moving the wheel out of the recess and along a surface of the cam-disc, the cam-disc locking surface becomes engaged with the blocking surface of the dead-bolt extension and the dead bolt is held in a locked position.

7. The locking device according to claim 6, wherein the link mechanism includes a swivel plate, a link arm having one end connected to the swivel plate, the other end connected to the hinged arm and a spring arranged so that the cam-disc is moved either with or against the force of the spring.

* * * * *

UNITED STATES PATENT AND TRADEMARK OFFICE

CERTIFICATE OF CORRECTION

PATENT NO. 5,931,515

DATED August 3, 1999

INVENTOR(S) Jan STENDAL

It is certified that error appears in the above-indentified patent and that said Letters Patent is hereby corrected as shown below:

Title page:

[22] PCT Filed: Change "Feb. 17, 1995" to

--Feb. 12, 1996--.

Signed and Sealed this

Seventh Day of December, 1999

*Attest:*

Q. TODD DICKINSON

*Attesting Officer*

*Acting Commissioner of Patents and Trademarks*